US011256192B2

(12) United States Patent
Uekuri

(10) Patent No.: US 11,256,192 B2
(45) Date of Patent: Feb. 22, 2022

(54) IMAGE FORMING APPARATUS

(71) Applicant: KYOCERA Document Solutions Inc., Osaka (JP)

(72) Inventor: Yoichi Uekuri, Osaka (JP)

(73) Assignee: KYOCERA DOCUMENT SOLUTIONS INC., Osaka (JP)

( * ) Notice: Subject to any disclaimer, the term of this patent is extended or adjusted under 35 U.S.C. 154(b) by 0 days.

(21) Appl. No.: 17/106,528

(22) Filed: Nov. 30, 2020

(65) Prior Publication Data

US 2021/0181652 A1 Jun. 17, 2021

(30) Foreign Application Priority Data

Dec. 13, 2019 (JP) ..... JP2019-225156

(51) Int. Cl.
*G03G 15/08* (2006.01)

(52) U.S. Cl.
CPC ..... *G03G 15/0856* (2013.01)

(58) Field of Classification Search
CPC ..... G03G 15/0856; G03G 15/0877; G03G 15/556
See application file for complete search history.

(56) References Cited

U.S. PATENT DOCUMENTS 4,260,073 A * 4/1981 Baumann ..... G03G 21/10 118/691
4,963,938 A * 10/1990 Sonoda ..... G03G 15/0856 399/106
5,122,837 A * 6/1992 Sonoda ..... G03G 15/0855 222/DIG. 1
5,508,795 A * 4/1996 Kikuchi ..... G03G 21/1814 399/262
5,659,837 A * 8/1997 Jo ..... G03G 15/0865 399/25
7,031,012 B1 * 4/2006 Serizawa ..... G03G 15/5079 358/1.16
9,390,355 B2 * 7/2016 Sayama ..... G06K 15/4075
2006/0159472 A1 * 7/2006 Ushiroji ..... G03G 15/0872 399/27
2006/0177241 A1 * 8/2006 Sato ..... G03G 15/0893 399/254
2007/0071502 A1 * 3/2007 Shimizu ..... G03G 15/0872 399/258
2008/0187357 A1 * 8/2008 Miura ..... G03G 15/0896 399/120

(Continued)

FOREIGN PATENT DOCUMENTS

JP 2017-015754 1/2017

*Primary Examiner* — David J Bolduc
(74) *Attorney, Agent, or Firm* — Lex IP Meister, PLLC

(57) ABSTRACT

The control unit controls supply of toner from the toner container to the developing device. The control unit is capable of executing a normal supply in which toner is supplied from the toner container to the developing device based on a detection result of the toner amount detection sensor, and a toner installation mode in which a larger amount of toner than the normal supply is supplied from the toner container to the developing device. When the toner installation mode is selected, the control unit calculates a toner amount T1 required for executing the toner installation mode and a toner remaining amount T2 in the toner container, and prohibits the execution of the toner installation mode when T1>T2.

5 Claims, 4 Drawing Sheets

(56) References Cited

U.S. PATENT DOCUMENTS

| | | | | |
|---|---|---|---|---|
| 2009/0016777 | A1* | 1/2009 | Miyamoto | G03G 15/0855 399/238 |
| 2009/0110417 | A1* | 4/2009 | Homma | G03G 15/0849 399/44 |
| 2010/0254720 | A1* | 10/2010 | Ajima | G03G 15/0266 399/12 |
| 2012/0014701 | A1* | 1/2012 | Tokuno | G03G 15/5079 399/12 |
| 2012/0294632 | A1* | 11/2012 | Nishikawa | G03G 15/0879 399/27 |
| 2013/0308969 | A1* | 11/2013 | Hasegawa | G03G 15/0266 399/50 |
| 2015/0339559 | A1* | 11/2015 | Sayama | G03G 15/556 358/1.15 |
| 2016/0033895 | A1* | 2/2016 | Noda | G03G 15/0865 399/12 |
| 2016/0124366 | A1* | 5/2016 | Shimazu | G03G 15/0879 399/27 |
| 2016/0202627 | A1* | 7/2016 | Kidaka | G03G 15/0266 399/50 |
| 2016/0378019 | A1* | 12/2016 | Asaka | G03G 15/0856 399/27 |
| 2016/0378020 | A1* | 12/2016 | Asaka | G03G 15/0863 399/27 |
| 2020/0133197 | A1* | 4/2020 | Kaida | G03G 15/5004 |

* cited by examiner

IMAGE FORMING APPARATUS

INCORPORATION BY REFERENCE

This application is based upon and claims the benefit of priority from the corresponding Japanese Patent Application No. 2019-225156 filed on Dec. 13, 2019, the entire contents of which are incorporated herein by reference.

BACKGROUND

The present disclosure relates to an image forming apparatus capable of supplying toner to a developing device.

Generally, in a one component developing type image forming apparatus using a magnetic one component developer made only of a magnetic toner, a method of supplying (installing) toner from a toner container into a new developing device when a user replaces the developing device is known. In the image forming apparatus having the toner amount detection sensor, the amount of toner supplied from the toner container to the developing device is controlled in accordance with the output value of the toner amount detection sensor.

On the other hand, some of the developing devices to be replaced do not have identification function such as an IC tag for cost reduction. In such a developing device, since it is not possible to determine whether the developing device has been replaced, or whether the developing device is new or used, the toner installation mode is executed for filling the developing device with toner regardless of whether toner is present in the developing device. That is, when the toner installation mode is started, it is not possible to confirm whether the developing device is a new one, and therefore, it is not possible to determine whether the developing device is in the toner installation mode that has been performed by replacing the developing device.

Therefore, in a state where there is no toner in the unit such as a new developing device, toner supply from a toner container is required, but in a case where the developing device is used in a state where there is toner in the developing device, toner supply is hardly required. That is, the amount of toner required in the toner installation mode varies depending on the use condition of the developing device.

As such an image forming apparatus, there is known an image forming apparatus which includes a developing device, a toner container including data indicating whether the toner container is an installation toner container or a replacement toner container, a toner container including a memory for storing the value of a remaining amount related item, a supplying unit for supplying the toner to the developing device, a reading/writing unit for reading/writing the memory, and a control unit for gradually decreasing the current value of the remaining amount related item in accordance with the number of printed sheets, and which stores in the memory a value based on the remaining amount of toner after installation when the developing device is filled with toner in a state where the installation toner container is attached, and a value based on the remaining amount of toner before installation when the installation toner container is attached after installation.

SUMMARY

An image forming apparatus according to an aspect of the present disclosure includes an image carrier, a developing device, a toner amount detection sensor, a toner container, and a control unit. A photosensitive layer is formed on the surface of the image bearing member. The developing device includes a replaceable developing container that stores a one component developer including a magnetic toner, and a toner bearing member that bears the toner in the developing container. The developing device forms a toner image by causing the toner to adhere to an electrostatic latent image formed on a surface of the image bearing member. The toner amount detection sensor detects the amount of toner in the developing device. The toner container stores toner to be supplied to the developing device. The control unit controls supply of toner from the toner container to the developing device. The control unit is configured to execute a normal supply in which toner is supplied from the toner container to the developing device based on a detection result of the toner amount detection sensor, and a toner installation mode in which a larger amount of toner than the normal supply is supplied from the toner container to the developing device. When the toner installation mode is selected, the control unit calculates a toner amount T1 required for executing the toner installation mode and a toner remaining amount T2 in the toner container, and prohibits the execution of the toner installation mode when T1>T2.

DETAILED DESCRIPTION

Hereinafter, embodiments of the present disclosure will be described with reference to the drawings.

Figure 1:
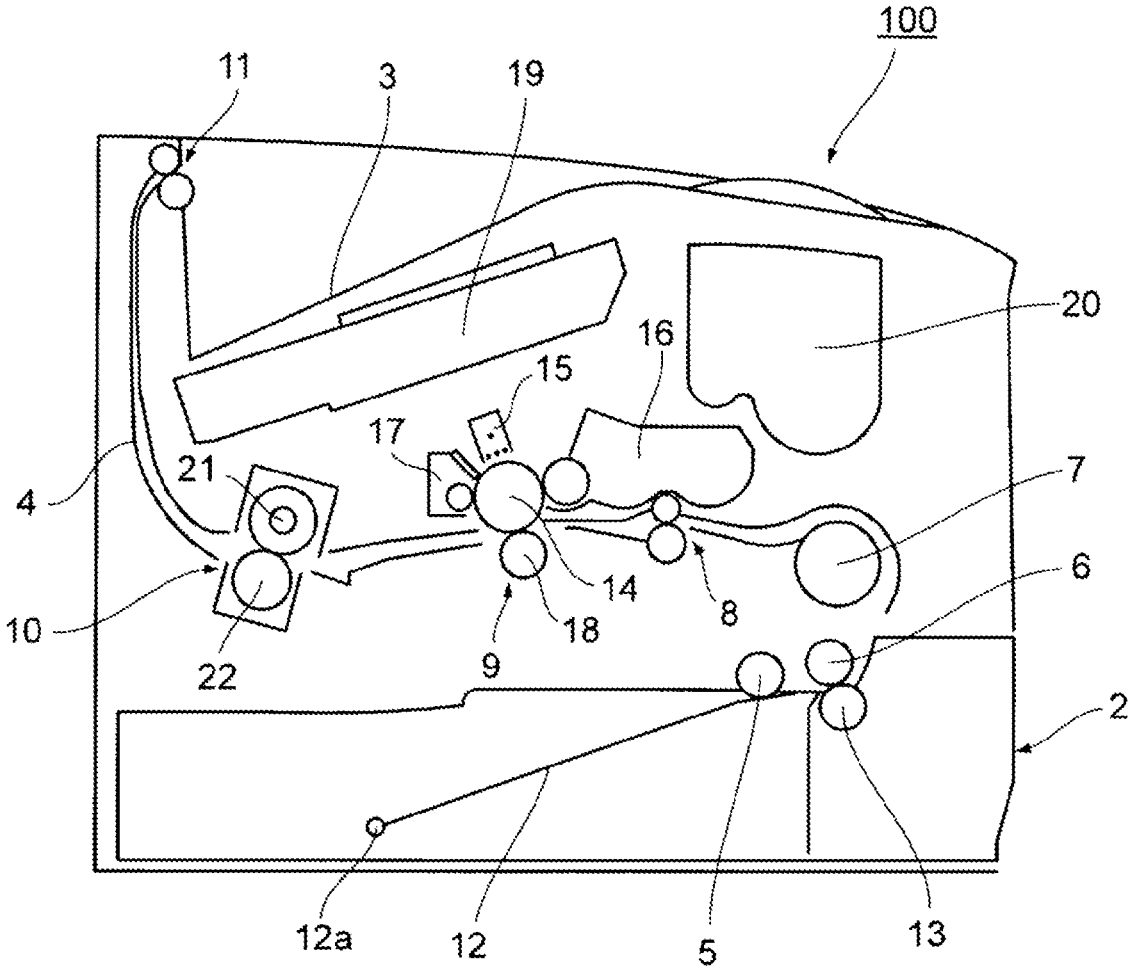
FIG. 1 is a schematic sectional view overall configuration of an image forming apparatus 100 according to an embodiment of the present disclosure.

FIG. 1 is a schematic view of an overall configuration of an image forming apparatus 100 according to an embodiment of the present disclosure. As shown in FIG. 1, the image forming apparatus (here, a monochrome printer) 100 is provided with a sheet feeding cassette 2 that accommodates sheets stacked in a lower portion of a main body. Above the sheet feeding cassette 2, a sheet conveying path 4 extends substantially horizontally from the front side of the main body to the rear side of the main body and further extends upward to reach a sheet discharging unit 3 formed on the upper surface of the main body. A pickup roller 5, a feed roller 6, an intermediate conveying roller 7, a registration roller pair 8, an image forming unit 9, a fixing unit 10, and a discharge roller pair 11 are arranged in this order from the upstream side along the sheet conveying path 4.

The sheet feeding cassette 2 is provided with a sheet loading plate 12 rotatably supported with respect to the sheet feeding cassette 2 by a rotation fulcrum 12*a* provided at a rear end part in a sheet conveying direction, and the sheet loaded on the sheet loading plate 12 is pressed by the pickup roller 5. A retard roller 13 is disposed in a front portion of the sheet feeding cassette 2 so as to be pressed against the feed roller 6. When a plurality of sheets are simultaneously fed by the pickup roller 5, the sheets are separated by the feed roller 6 and the retard roller 13, and only the uppermost 1 sheet is conveyed.

The sheet separated by the feed roller 6 and the retard roller 13 is conveyed to the registration roller pair 8 after the conveying direction is changed to the rear of the apparatus by the intermediate conveying roller 7, and is conveyed to the image forming unit 9 after the timing is adjusted by the registration roller pair 8.

The image forming unit 9 forms a predetermined toner image on a sheet by an electrophotographic process. The image forming unit 9 includes a photosensitive drum 14, which is an image carrier rotatably supported in a clockwise direction in FIG. 1, a charging device 15, a developing device 16, and a cleaning device 17 disposed around the photosensitive drum 14, a transfer roller 18 disposed to face the photosensitive drum 14 with a sheet conveying path 4 therebetween, and an exposure device (laser scanning unit) 19 disposed above the photosensitive drum 14. A toner container 20 for supplying toner to the developing device 16 as necessary is disposed above the developing device 16.

The photosensitive drum 14 is an aluminum drum on which a photosensitive layer is stacked. Examples of the photosensitive material which forms the photosensitive layer include an amorphous silicon photoreceptor and an organic photoreceptor (OPC photoreceptor). Examples of the charging device 15 are a scorotron charging device which makes use of corona discharge, and a contact charging device which uses a charging roller. By applying a predetermined charging voltage to the charging device 15, the surface of the photosensitive drum 14 is uniformly charged with a predetermined polarity (same as the polarity of the toner) and potential.

Next, the surface of the photosensitive drum 14 is exposed to a laser beam from an exposure device 19 based on image data input from a host device such as a personal computer, and an electrostatic latent image in which charging is attenuated is formed. Then, the developing device 16 is used to cause toner to adhere to the electrostatic latent image to form a toner image on the surface of the photosensitive drum 14.

The toner image formed on the photosensitive drum 14 is transferred by the transfer roller 18 onto a sheet supplied to a transfer position formed at a nip portion between the photosensitive drum 14 and the transfer roller 18. The sheet on which the toner image has been transferred is separated from the photosensitive drum 14 and conveyed toward the fixing unit 10. The fixing unit 10 is disposed on the downstream side of the image forming unit 9 with respect to the sheet conveying direction, and the sheet to which the toner image is transferred in the image forming unit 9 is sandwiched and heated by a heating roller 21 provided in the fixing unit 10 and a pressure roller 22 pressed against the heating roller 21, and the toner image transferred to the sheet is fixed.

Then, the sheet that has passed through the image forming unit 9 and the fixing unit 10 is discharged to the sheet discharging unit 3 by the discharge roller pair 11. On the other hand, the toner remaining on the surface of the photosensitive drum 14 is removed by the cleaning device 17. Then, the photosensitive drum 14 is charged again by the charging device 15, and image formation is performed in the same manner.

Figure 2:
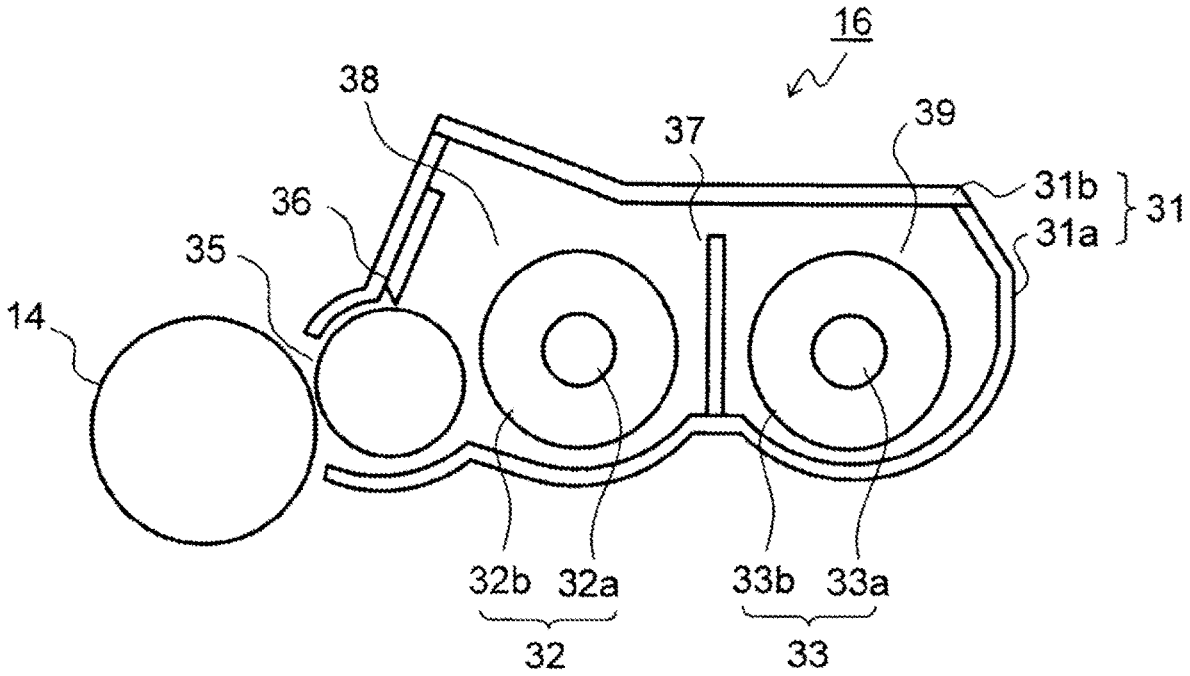
FIG. 2 is a side sectional view of the developing device 16 used in the image forming apparatus 100 of the present embodiment.

FIG. 2 is a side sectional view of the developing device 16 mounted in the image forming apparatus 100 of the present embodiment. The developing device 16 is attachable to and detachable from the image forming apparatus 100, and as shown in FIG. 2, first and second agitating and conveying screws 32 and 33, a developing roller 35, and a regulating blade 36 are provided in a developing container 31 including a container body 31*a* in which a magnetic one component developer (hereinafter, referred to as toner) made of magnetic toner is stored and a cover 31*b* that seals the container body 31*a* so that the toner stored in the container body 31*a* does not leak to the outside.

The inside of the container body 31*a* is partitioned into a first storage chamber 38 and a second storage chamber 39 by a partition wall 37 extending in the longitudinal direction, and a first agitating and conveying screw 32 is arranged in the first storage chamber 38 and a second agitating and conveying screw 33 is arranged in the second storage chamber 39. In addition, the partition wall 37 is not provided at both end portions in the longitudinal direction (direction perpendicular to the sheet surface) of the container body 31*a*, and these portions serve as a communication path through which the toner moves between the first storage chamber 38 and the second storage chamber 39.

The first agitating and conveying screw 32 and the second agitating and conveying screw 33 are respectively composed of rotary shafts 32*a* and 33*a* and spiral blades 32*b* and 33*b* integrally formed on the outer peripheral surfaces of the rotary shafts 32*a* and 33*a*, and are rotatably supported in the container body 31*a* so as to be substantially parallel to each other. The first agitating and conveying screw 32 and the second agitating and conveying screw 33 rotate in a predetermined direction to circulate and convey the toner in the first storage chamber 38 and the second storage chamber 39. The cover 31*b* is provided with a toner supply port (not shown) through which the toner is supplied from the toner container 20 (see FIG. 1) so that the toner can be supplied into the container body 31*a* in accordance with the detection result of the toner amount detection sensor 40 (see FIG. 3).

The developing roller 35 is rotatably supported in the first storage chamber 38 so as to be substantially parallel to the first agitating and conveying screw 32 and the second agitating and conveying screw 33. A magnet roller (not shown) formed of a permanent magnet having a plurality of magnetic poles is fixed inside the developing roller 35, and when the developing roller 35 rotates in accordance with the rotation of the photosensitive drum 14, the toner is attached (carried) to the surface of the developing roller 35 by the magnetic force of the magnet roller to form a toner layer. Then, the toner adhering to the developing roller 35 in the predetermined developing area flies to the photosensitive drum 14 due to the potential difference between the surface potential of the photosensitive drum 14 and the developing voltage (for example, DC voltage Vdc=280V, AC voltage Vpp=1.7 kV, frequency 2.3 kHz) applied to the developing roller 35 and adheres to the photosensitive layer, whereby a toner image is formed on the photosensitive drum 14.

The regulating blade 36 regulates the amount of toner supplied to the photosensitive drum 14, that is, the amount of toner attached to the developing roller 35. For example, a magnetic material such as SUS (stainless steel) is used. The regulating blade 36 is disposed so that a predetermined gap is formed between the tip thereof and the developing roller 35, the amount of toner adhering to the developing roller 35 is regulated by the gap generated between the regulating blade 36 and the developing roller 35 and a magnetic field generated in the gap, and a toner thin layer of several tens of microns is formed on the surface of the developing roller 35.

Figure 3:
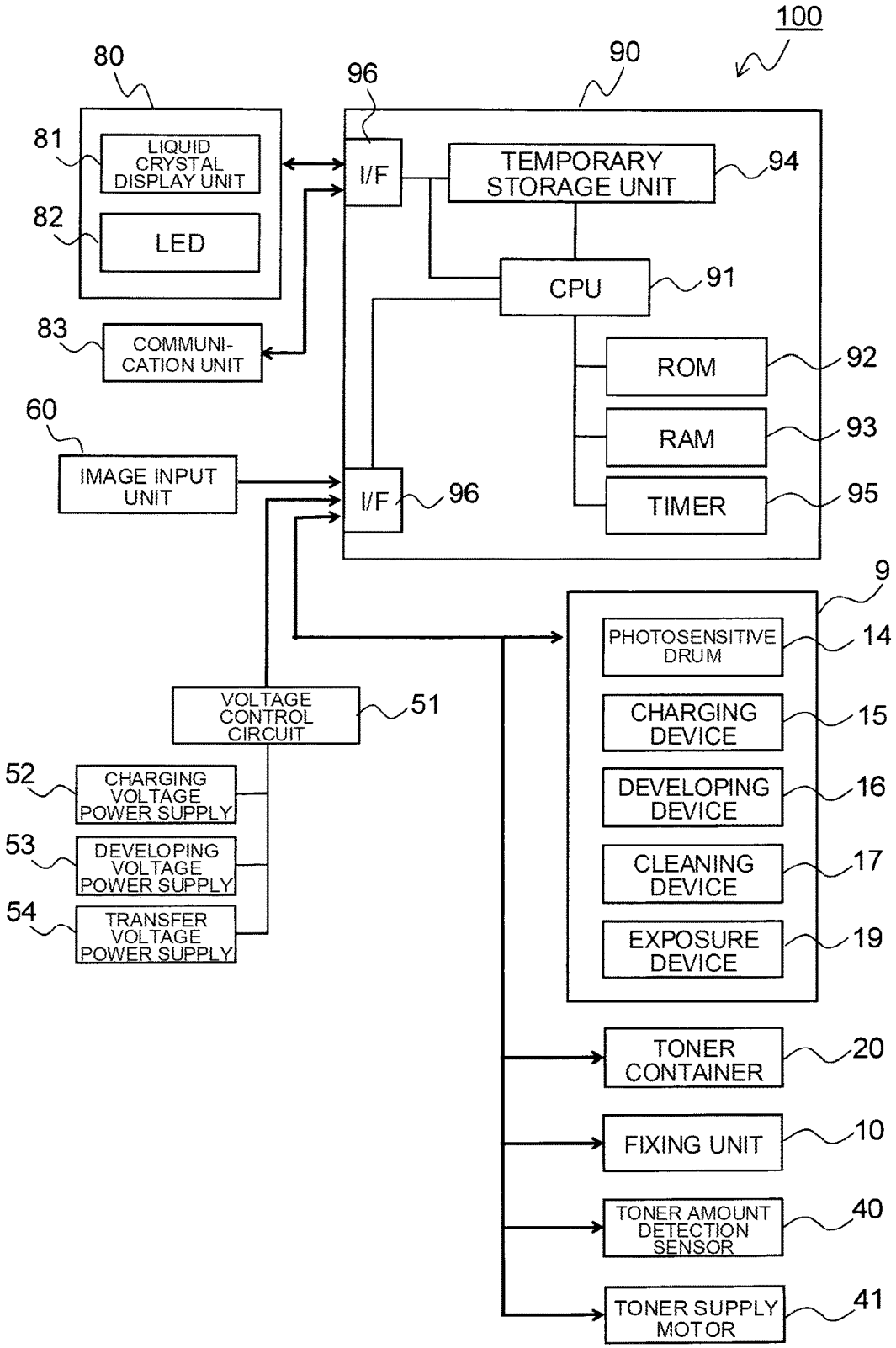
FIG. 3 is a block diagram illustrating a control path of the image forming apparatus 100 according to the present exemplary embodiment.

Next, a control path of the image forming apparatus 100 will be described. FIG. 3 is a block diagram showing an example of a control path used in the image forming apparatus 100 of the present embodiment. In addition, since various controls of each unit of the apparatus are performed in using the image forming apparatus 100, a control path of the entire image forming apparatus 100 becomes complicated. Therefore, a portion of the control path necessary for carrying out the present invention will be mainly described.

The control unit 90 includes at least a CPU (Central Processing Unit) 91 as a central processing unit, a ROM (Read Only Memory) 92 as a read-only storage unit, a RAM (Random Access Memory) 93 as a readable and writable storage unit, a temporary storage unit 94 for temporarily storing image data and the like, and a plurality of (here, two) I/Fs (interfaces) 96 for transmitting a control signal to each device in the image forming apparatus 100 and receiving an input signal from the operation unit 80. The control unit 90 can be disposed at any position inside the image forming apparatus 100.

The ROM92 stores a control program for the image forming apparatus 100, numerical values required for control, and the like, which are not changed during use of the image forming apparatus 100. The RAM93 stores necessary data generated during the control of the image forming apparatus 100, data temporarily necessary for the control of the image forming apparatus 100, and the like. The RAM93 also stores a target value (reference value) of a toner filling amount in the developing device 16 used for calculating toner amounts T1 and T2 when a toner installation mode to be described later is executed, an initial toner storage amount of the toner container 20, an average printing rate from the start of use of the toner container 20, a cumulative number of printed sheets, and the like.

In addition, the control unit 90 transmits a control signal to each part and device in the image forming apparatus 100 through CPU91 to I/F96. A signal indicating the state of each part or device and an input signal are transmitted from each part or device to CPU91 through I/F96. Examples of the components and devices controlled by the control unit 90 include the sheet feeding cassette 2, the fixing unit 10, the developing device 16, the exposure device 19, the toner container 20, the toner amount detection sensor 40, the toner supply motor 41, the voltage control circuit 51, the image input unit 60, the operation unit 80, and the communication unit 83.

The toner amount detection sensor 40 is provided in the vicinity of a mounting portion of the developing device 16 in the image forming apparatus 100, and detects the amount of toner in the developing device 16. In accordance with the detection result of the toner amount detection sensor 40, the toner stored in the toner container 20 (see FIG. 1) is supplied into the developing container 31 via a toner supply port (not shown) provided in the cover 31*b* of the developing container 31. A magnetic permeability sensor that detects the magnetic permeability of the toner in the developing device 16 is used as the toner amount detection sensor 40. The toner amount detection sensor 40 may be disposed in the developing device 16, too.

Further, since the amount of toner necessary for toner installation is calculated based on the detection result of the toner amount detection sensor 40 as described later, the toner amount detection sensor 40 needs to accurately detect the amount of toner in the developing device 16. Therefore, it is preferable to use the toner amount detection sensor 40 having a wide detection area (detection surface) included in the detection range from the bottom portion to the upper portion of the developing container 31.

The toner supply motor 41 supplies the toner stored in the toner container 20 to the developing device 16 at a predetermined speed. In the present embodiment, the magnetic permeability of the developer is detected by the toner amount detection sensor 40, and a voltage value corresponding to the detection result is output to the control unit 90. The control unit 90 determines the amount of toner in the developing device 16 from the output value of the toner amount detection sensor 40, transmits a control signal to the toner supply motor 41 in accordance with the determined amount of toner, and supplies a predetermined amount of toner from the toner container 20 to the developing device 16 (normal supply).

The voltage control circuit 51 is connected to the charging voltage power supply 52, the developing voltage power supply 53, and the transfer voltage power supply 54, and operates these power supplies in response to output signals from the control unit 90. The charging voltage power supply 52 applies a predetermined voltage to the charging device 15, the developing voltage power supply 53 applies a predetermined voltage to the developing roller 35 in the developing device 16, and the transfer voltage power supply 54 applies a predetermined voltage to the transfer roller 18 in response to control signals from the voltage control circuit 51.

The image input unit 60 is a receiving unit that receives image data transmitted from a personal computer or the like. An image signal input from the image input unit 60 is converted into a digital signal and then sent to the temporary storage unit 94.

The operation unit 80 is provided with a liquid crystal display unit 81 and a LED82 indicating various states, and is configured to indicate the state of the image forming apparatus 100 and to display the image forming state and the number of copies to be printed. Various settings of the image forming apparatus 100 are performed by a printer driver of a personal computer.

In addition, the operation unit 80 is provided with a start button for a user to give an instruction to start image formation, a stop/clear button used to stop image formation or the like, a reset button used to set various settings of the image forming apparatus 100 to a default state, and the like.

The communication unit 83 performs wired or wireless data communication with an external device such as a personal computer via a communication network such as the Internet or a LAN. In the present embodiment, as will be described later, the communication unit 83 can transmit order data of a new toner container 20 to a distribution center, a dealer, or the like.

In the image forming apparatus 100 of the present embodiment, when the toner in the developing device 16 runs out, a toner installation mode is executed in which the developing device 16 is removed and replaced with an unused developing device 16, and a larger amount of toner is supplied to the developing device 16 than in a case where toner is supplied at the time of image formation (normal supply). Alternatively, even when the developing device 16 is not replaced, for example, when the toner container 20 is replaced and new toner is supplied, the toner installation mode may be executed to stabilize the charged state of the toner. At this time, in a case where the developing device 16 does not have an identification function such as an IC tag, it is not possible to determine whether or not the developing device 16 is an unused product in which the toner inside is empty.

The toner installation mode needs to be continued until a predetermined amount of toner is supplied in the developing device 16. However, in a case where the toner installation mode is executed in a state where the remaining amount of toner in the toner container 20 is small, even if all the toner in the toner container 20 is supplied to the developing device 16, a predetermined amount of toner is not supplied in the developing device 16, and the toner installation mode is temporarily stopped. As a result, the image forming apparatus 100 is left for a long time in a state in which the toner installation is not completed, and there is a concern that a defect such as image fogging or a decrease in image density may occur after the toner container 20 is replaced and the installation is completed.

Therefore, in the present embodiment, when the toner installation mode is selected, a toner amount T1 necessary for filling a predetermined amount of toner into the developing device 16 and a toner remaining amount T2 in the toner container 20 are calculated. When the toner amount T1 required for the toner installation is larger than the toner remaining amount T2, the execution of the toner installation mode is prohibited.

Figure 4:
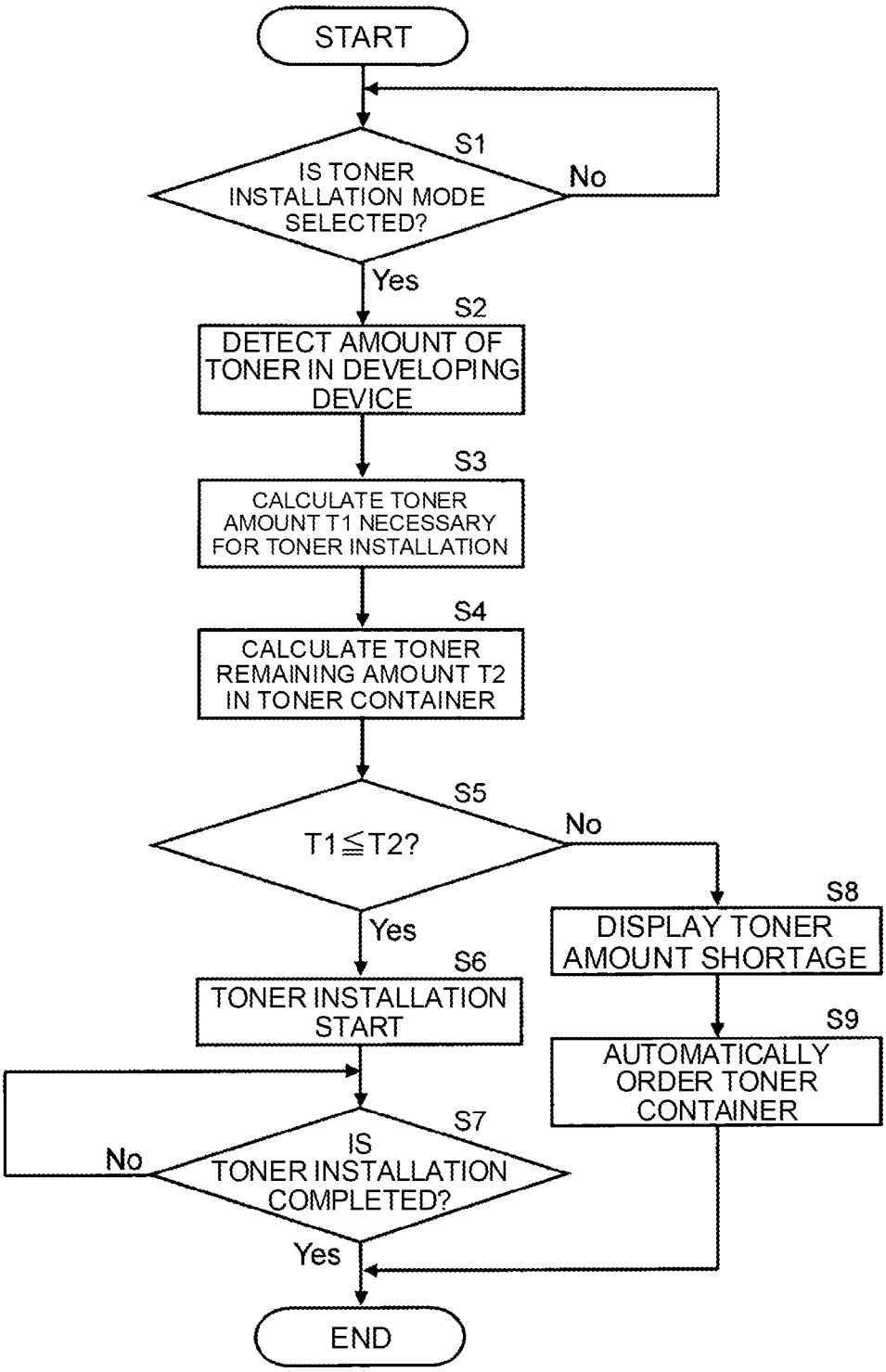
FIG. 4 is a flowchart showing a control example of the toner installation mode in the image forming apparatus 100 of the present embodiment.

FIG. 4 is a flowchart showing a control example of the toner installation mode in the image forming apparatus 100 of the present embodiment. Referring to FIGS. 1 to 3, an execution procedure of the toner installation will be described along the steps of FIG. 4.

First, the control unit 90 determines whether or not the toner installation mode is selected (step S1). When the toner installation mode is selected (Yes in step S1), the amount of toner in the developing device 16 is detected by the toner amount detection sensor 40 (step S2). The detection result of the toner amount detection sensor 40 is transmitted to the control unit 90.

Next, the control unit 90 calculates a toner amount T1 necessary for toner installation based on the detected toner amount in the developing device 16 (step S3). The toner amount T1 is calculated by subtracting the detected toner amount from the target value of the toner filling amount of the developing device 16 stored in RAM93 (or ROM92).

Next, the control unit 90 calculates the toner remaining amount T2 in the toner container 20 (step S4). The toner remaining amount T2 is calculated by subtracting the toner amount (toner consumption amount) consumed by the printing operation, from the toner remaining amount (initial toner storage amount) at the start of use of the toner container 20 stored in RAM93 (or ROM92). The toner consumption amount is calculated based on the average printing rate and the cumulative number of printed sheets from the start of use of the toner container 20 stored in RAM93 (or ROM92).

Next, the control unit 90 determines whether or not $T1<T2$ is satisfied (step S5). If $T1<T2$ is satisfied (Yes in step S3), the toner remaining amount T2 in the toner container 20 is equal to or larger than the toner amount T1 necessary for toner installation to the developing device 16, and thus a toner installation mode for supplying toner from the toner container 20 to the developing device 16 is started (step S6).

Thereafter, the control unit 90 determines whether or not the toner installation is completed, that is, whether or not the toner amount detection sensor 40 detects that the toner is supplied to a predetermined level (step S7). When the toner is not supplied up to prescribed level (No in step S7), the toner installation is continued. When the toner is supplied to the specified level (Yes in step S7), the process is terminated.

On the other hand, when $T1>T2$ is satisfied (No in step S3), the toner remaining amount T2 in the toner container 20 is smaller than the toner amount T1 necessary for toner installation in the developing device 16, and thus the toner remaining amount shortage in the toner container 20 is displayed on the liquid crystal display unit 81 without starting the toner installation mode (step S8). Then, the toner container 20 for replacement is automatically ordered by the communication unit 83 (step S9), and the process ends.

According to the above-described control example, when the remaining amount of toner in the toner container 20 is not equal to or more than the amount of toner necessary for the toner installation from the toner container 20 to the developing device 16, the execution of the toner installation is stopped. Therefore, there is no possibility that the image forming apparatus 100 is left for a long time during the toner installation. Therefore, it is possible to suppress the occurrence of an image defect after the completion of the toner installation due to the moisture absorption of the toner in the developing device 16 during the toner installation.

Further, when the remaining amount of toner in the toner container 20 is not equal to or more than the amount of toner necessary for toner installation, the liquid crystal display unit 81 displays the shortage of the remaining amount of toner in the toner container 20, and thus it is possible to notify the user to replace the toner container 20. Further, by automatically ordering the toner container 20 for replacement by the communication unit 83, inventory management of the toner container 20 becomes unnecessary.

The addition, the present invention is not limited to the above-described can be made without departing from the scope of the present invention. For example, unless otherwise specified, the dimensions, materials, shapes, relative arrangements, and the like of the components described in the above embodiments are not intended to limit the scope of the present invention, and are merely explanatory examples.

Further, needless to mention, the present invention is not limited to the monochrome printer shown in FIG. 1, but can be applied to various image forming apparatuses including a developing device to which one component developer is supplied from a toner container, such as an analog type monochrome copying machine, a rotary type or tandem type color copying machine, a color printer, a copying machine such as an analog type monochrome copying machine, and a facsimile.

The present disclosure is applicable to an image forming apparatus capable of supplying toner to a detachable developing device. According to the present disclosure, it is possible to provide an image forming apparatus capable of suppressing moisture absorption of toner in a developing device due to interruption of a toner installation mode and occurrence of an image defect caused by the moisture absorption.

What is claimed is:

1. An image forming apparatus comprising:

an image carrier having a surface on which a photosensitive layer is formed;

a replaceable developing device that includes a developing container in which a one component developer including a magnetic toner is stored and a toner bearing member that bears the toner in the developing container, and that forms a toner image by causing the toner to adhere to an electrostatic latent image formed on a surface of the image carrier;

a toner amount detection sensor configured to detect an amount of toner in the developing device;

a toner container configured to store the toner to be supplied to the developing device; and a control unit configured to control supply of the toner from the toner container to the developing device, wherein the control unit is configured to execute:

a normal supply in which the toner is supplied from the toner container to the developing device based on a detection result of the toner amount detection sensor; and a toner installation mode in which a larger amount of the toner than the normal supply is supplied from the toner container to the developing device, and when the toner installation mode is selected, the control unit calculates a toner amount T1 required to execute the toner installation mode and a toner remaining amount T2 in the toner container, and prohibits execution of the toner installation mode when T1>T2.

2. The image forming apparatus according to claim 1, comprising a notification device configured to notify a state of each part of the image forming apparatus including the toner container, wherein when T1>T2, the control unit uses the notification device to perform notification for urging replacement of the toner container.

3. The image forming apparatus according to claim 1, comprising a communication unit configured to communicate via a network, wherein when T1>T2, the control unit automatically orders the toner container for replacement by using the communication unit.

4. The image forming apparatus according to claim 1, comprising a storage unit that stores a target value of a toner filling amount of the developing device and an initial toner storage amount of the toner container, wherein the control unit calculates the toner amount T1 by subtracting the toner amount in the developing device detected by the toner amount detection sensor, from the target value of the toner filling amount, and the toner remaining amount T2 is calculated by subtracting a toner consumption amount consumed by a printing operation, from the initial toner storage amount.

5. The image forming apparatus according to claim 4, wherein the toner consumption amount is calculated based on an average printing rate and a cumulative number of printed sheets from the start of use of the toner container stored in the storage unit.

* * * * *